US009630049B2

(12) United States Patent
Hartman et al.

(10) Patent No.: US 9,630,049 B2
(45) Date of Patent: Apr. 25, 2017

(54) RECIPROCATING REHABILITATION DEVICE

(71) Applicants: Joseph D Hartman, Naperville, IL (US); Eugene L DiMonte, Aurora, IL (US)

(72) Inventors: Joseph D Hartman, Naperville, IL (US); Eugene L DiMonte, Aurora, IL (US)

( * ) Notice: Subject to any disclaimer, the term of this patent is extended or adjusted under 35 U.S.C. 154(b) by 0 days.

(21) Appl. No.: 14/859,830

(22) Filed: Sep. 21, 2015

(65) Prior Publication Data

US 2017/0080281 A1 Mar. 23, 2017

(51) Int. Cl.

| | |
|---|---|
| ***A63B 22/06*** | (2006.01) |
| ***A63B 21/00*** | (2006.01) |
| ***A63B 21/015*** | (2006.01) |
| ***A63B 21/22*** | (2006.01) |
| ***A63B 23/04*** | (2006.01) |

(52) U.S. Cl.

CPC .... *A63B 21/4045* (2015.10); *A63B 21/00069* (2013.01); *A63B 21/015* (2013.01); *A63B 21/225* (2013.01); *A63B 21/4034* (2015.10); *A63B 23/04* (2013.01)

(58) Field of Classification Search

USPC ..... 482/1–148

See application file for complete search history.

(56) References Cited

U.S. PATENT DOCUMENTS

| | | | | | |
|---|---|---|---|---|---|
| 3,704,886 | A * | 12/1972 | Kay | A63B 21/0125 | 482/119 |
| 4,477,072 | A * | 10/1984 | DeCloux | A63B 22/0605 | 482/4 |
| 5,135,452 | A * | 8/1992 | Jones | A63B 23/03575 | 482/134 |
| 5,163,886 | A | 11/1992 | Seol | | |
| 5,466,204 | A * | 11/1995 | Nearing | A63B 21/16 | 482/100 |
| 5,722,921 | A * | 3/1998 | Simonson | A63B 21/155 | 482/100 |
| 5,765,847 | A * | 6/1998 | Toronto | B62M 1/28 | 280/237 |
| 6,010,433 | A * | 1/2000 | Chao | B62M 1/28 | 280/230 |
| 6,558,303 | B1 * | 5/2003 | Ellis | A63B 23/0494 | 482/100 |
| 6,619,682 | B1 * | 9/2003 | Carr | B62K 3/002 | 280/253 |
| 6,730,003 | B1 | 5/2004 | Phillips | | |
| 7,998,037 | B2 * | 8/2011 | Luquette | A63B 21/0552 | 482/103 |
| 8,864,628 | B2 * | 10/2014 | Boyette | A63B 24/0087 | 482/1 |
| 9,339,686 | B2 * | 5/2016 | Yeh | A63B 22/0605 | |
| 2009/0211395 | A1 | 8/2009 | Mul'E | | |

* cited by examiner

*Primary Examiner* — Stephen Crow

(57) ABSTRACT

A reciprocating rehabilitation device that can be used as a stand alone unit or incorporated within a stationary bicycle. The device utilizes independently operating pedals together with range of motion limiters. Patients and therapists alike can rehab each limb independently through any necessary progressive range of motion on the way to recovery.

8 Claims, 5 Drawing Sheets

RECIPROCATING REHABILITATION DEVICE

CROSS-REFERENCE TO RELATED APPLICATION

None.

BACKGROUND OF THE INVENTION

I. Field of the Invention

The present disclosure relates generally to rehabilitation devices and equipment with pedals that help people recover from joint injuries, surgeries or the like. More particularly, it relates to reciprocating pedals, which are used by therapists, to repeatedly take an injured appendage through a limited, but adjustable, range of motion.

II. Description of the Prior Art

After an injury or surgery to the knee, for example, one of the first priorities is to begin to restore the range of motion to the affected joint. Typical range of motion of the knee can be measured in knee flexion and knee extension by a device called a goniometer. A goniometer has two pieces that are connected by a central hinge. By lining up each of the pieces along a specific joint area and having the individual move that joint, a value in degrees (measure of an angle where one degree (°) is one $360^{th}$ part of a full circle) can be observed and recorded. Knee flexion can be measured when an individual lies on their back and draws their heel to the back of their leg. Typical values for knee flexion are approximately 130-150°. Knee extension is the amount to which a person can straighten their leg. Typical values for knee extension are 0-10°.

Bicycles are human-powered modes of transportation typically consisting of a frame, two wheels, seat, handlebars, pedals, gears, and a chain. By using the pedals, one can propel the bicycle forward and can control the speed at which they move by varying their pedal speed along with changing an associated gearing system, if installed, of the bicycle.

Stationary bicycles allow an individual to remain in place as they pedal. Stationary bicycles are typically used in gyms or homes by individuals when the weather is not conducive for riding outside or for training/workout purposes. Stationary bicycles are also used by physical therapist/rehabilitation technicians for rehabilitation purposes. They allow an individual rehabbing to workout various muscles and joints without risking a fall. Additionally, an individual can rehab in such a way as to remove the weight from specific load bearing joints and muscles that may not be ready for full weight bearing exercises.

While stationary bicycles have been used for rehabilitation for many years, almost two-thirds of the 360° circular motion associated with conventional stationary bicycles is non-productive, especially with respect to rehabilitation, since the range of motion that effectively produces resistance is only 130°. Also, the full circular pedal motion of these bicycles requires 115° of knee flexion which is much more flexion than is required in normal walking or jogging motion. Thus, conventional stationary bicycles are unable to produce leg motion which uses the same body muscles as walking or jogging, and are unable to promote early rehabilitation after knee, hip, or ankle surgeries which require less than 115° of knee flexion. In fact, many rehabilitation efforts using the full cycling motion irritate the injured joint of patients with range of motion limitations.

Accordingly, there have been a plethora of attempts to design both new rehabilitation stationary bicycles as well as new stand alone and/or retro-fit rehabilitation devices that do not use, or perhaps limit, the full cycling motion. Such devices range, for example, from relatively simplistic adjustable pedal throw (radius) systems to fully automated systems that evaluate the condition of the patient, design a therapy program for the patient and then monitor the progress of the patient.

However, there still remains a need for a rehabilitation device that can be utilized by a patient with no or very little therapist aide. Indeed, even with all of the prior art designs, professional therapists still desire to stand next to a conventional stationary bicycle and help the patient position and reposition their limbs with every crank of the pedals. In particular, the therapist helps the patient onto the conventional stationary bicycle and positions the foot near the top of the cranking radius; the patient then provides the force to move the pedal to their maximum; the therapist then needs to reposition the foot back near the top; and the patient pushes again, and so on.

It is therefore a general object of this disclosure to provide a device for addressing the deficiencies of the current practices regarding issues associated with rehabilitation devices used after knee and other joint injuries or surgeries.

It is another general object of this disclosure to provide a rehabilitation device incorporated within a stationary bicycle.

It is another general object of the present disclosure to provide a standalone and/or retro-fit rehabilitation device.

It is more specific object of this disclosure to provide a rehabilitation device that takes an injured appendage through a limited, but adjustable, range of motion.

These and other objects, features and advantages of this disclosure will be clearly understood through a consideration of the following detailed description.

SUMMARY OF THE INVENTION

According to an embodiment of the present disclosure, there is provided a reciprocating rehabilitation device having a crank axle supported by a frame with a foot pedal coupled to the axle through a crank arm where the pedal has a circular range of motion about the axle. A resistance element resists a direction of pedal motion by the user while a force element urges pedal motion in the opposite direction. The range of motions of these pedal directions are adjustable.

There is also provided a reciprocating foot pedal assembly having a crank axle supported by a frame with left and right foot pedals coupled to opposite ends of the axle through respective crank arms wherein the pedals have circular range of motion about the axle. A resistance element resists a direction of pedal motion by the user while a force element urges pedal motion in the opposite direction. The range of motions of these pedal directions are adjustable.

BRIEF DESCRIPTION OF THE DRAWINGS

The present disclosure will be more fully understood by reference to the following detailed description of one or more preferred embodiments when read in conjunction with the accompanying drawings, in which like reference characters refer to like parts throughout the views and in which.

DESCRIPTION OF THE PREFERRED EMBODIMENTS

The following description of the preferred embodiments is merely exemplary in nature and is in no way intended to limit the disclosure, its application or use. These exemplars are merely used to better describe the true spirit and scope of the present disclosure.

Figure 1:
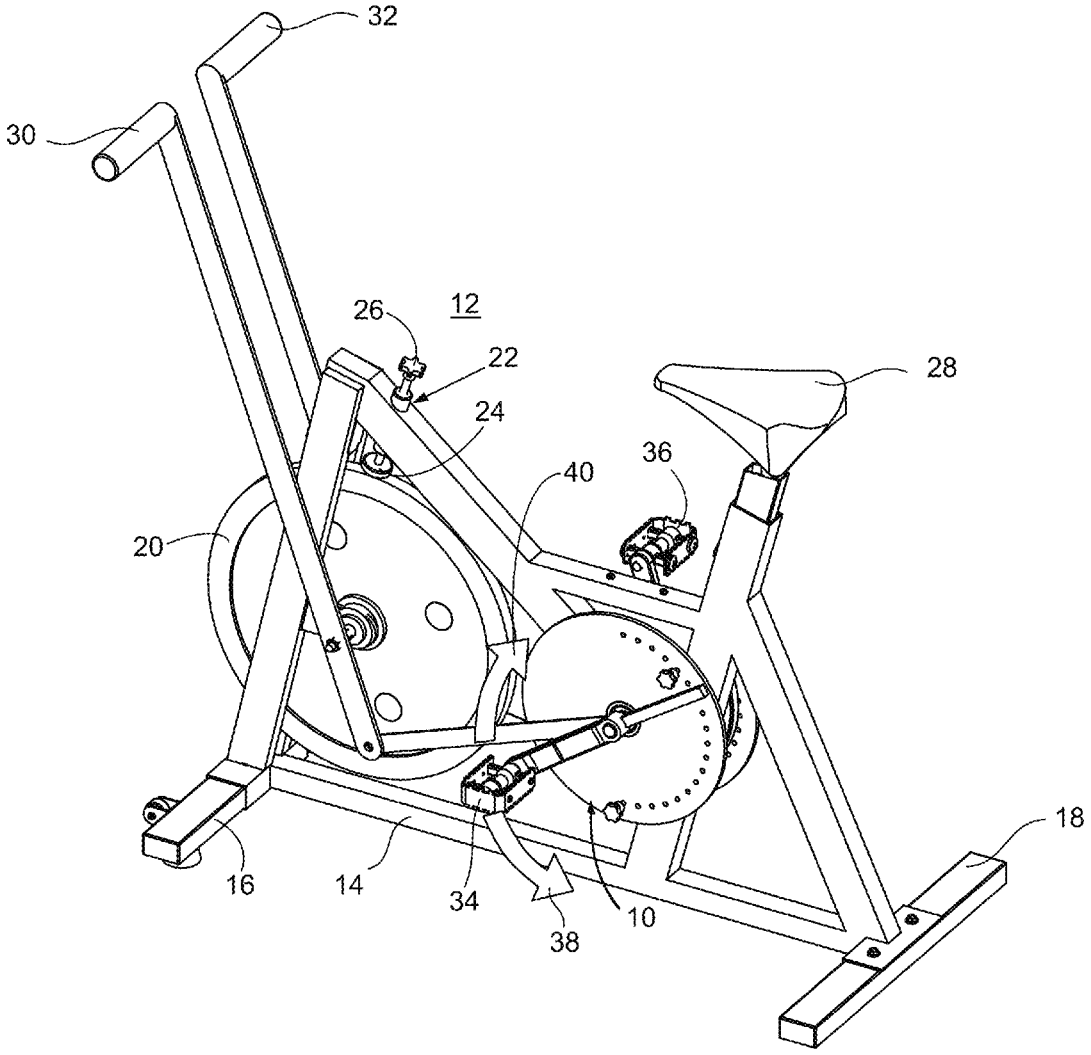
FIG. 1 is a perspective view of a reciprocating rehabilitation device according to the principles of an embodiment of the present invention as incorporated within a stationary bicycle.

Turning now to the Figures, and in particular FIG. 1, a pedal assembly, which may also be referred to as a reciprocating rehabilitation device, 10 is shown incorporated within a conventional stationary bicycle 12. It will be appreciated that the device may be a stand alone device with or without connection to or being incorporated with a stationary bicycle. The conventional stationary bicycle 12 may include a frame 14, including front and rear supports (16, 18), and a flywheel 20 having a resistance adjustment mechanism 22 including a brake pad 24 biased against the flywheel 20 via a screw type crank 26. As is well known in the art, when the user sits on the seat 28, he can either use the left and right handles (30, 32) and/or the left and right pedals (34, 36) to engage the flywheel 20 through their respective associated linkages.

Figure 2:
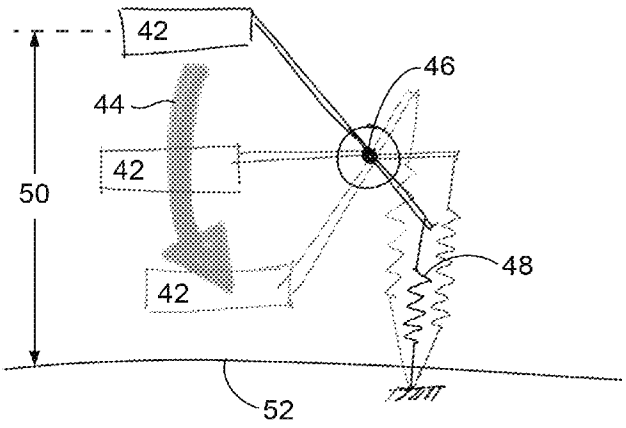
FIG. 2 is a simplified diagram of the basic motion of the pedals of the device of FIG. 1.

Rather than the pedals traversing a full 360° circle, as they would in a conventional stationary bicycle, the pedals of the reciprocating device 10 are moved down 38 by the user and then are forced up 40 and back to a starting position. This basic pedal motion is illustrated in the abstract drawing of FIG. 2. In particular, the pedal 42 moves 44 around a central point 46 and then a force mechanism 48 returns the pedal 42 to a starting position 50 from a reference point 52. The reciprocating motion, e.g. user forcing the pedal down 44 and the force mechanism 48 (for example a spring 54) urging the pedal back up 56, is better shown in FIG. 3. The pedal, via its crank, is coupled to a gear shaft or crank axle 58 via a one-way clutch, for example, which may then be connected to a flywheel (or other resistance element) through a chain 60, while the spring 54 is secured to a frame 62 through a fastener 64.

Figure 3:
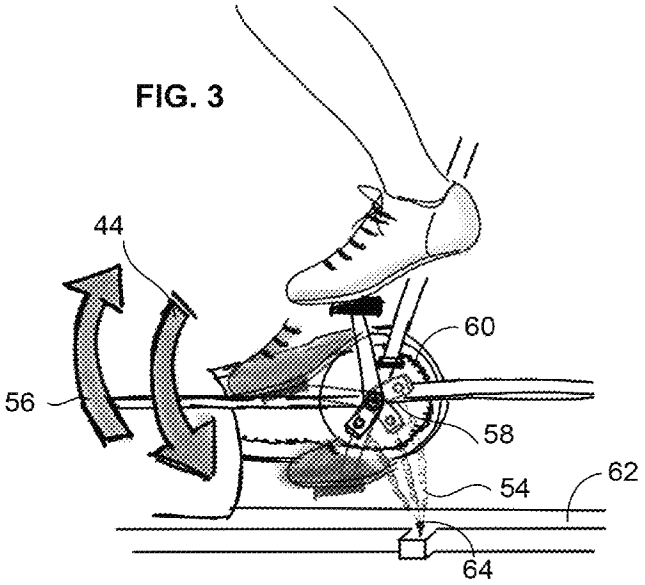
FIG. 3 is a simplified diagram of the reciprocating motion of user engaged pedals of the device of FIG. 1.
Figure 4C:
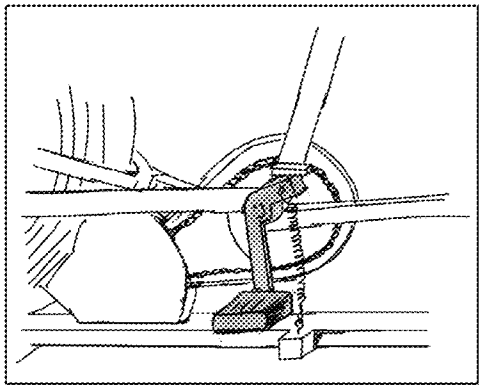
FIGS. 4*a*-4*c* are a series of simplified diagrams of various positions within the basic motions of the pedals of the device of FIG. 1.
Figure 4B:
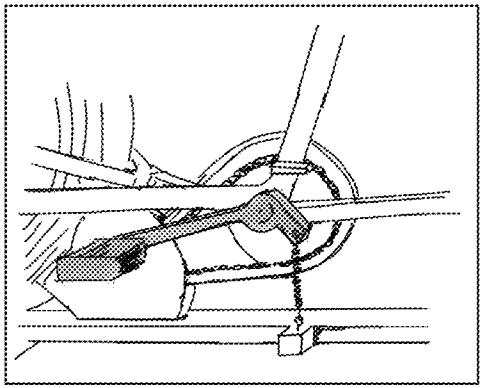
Figure 4A:
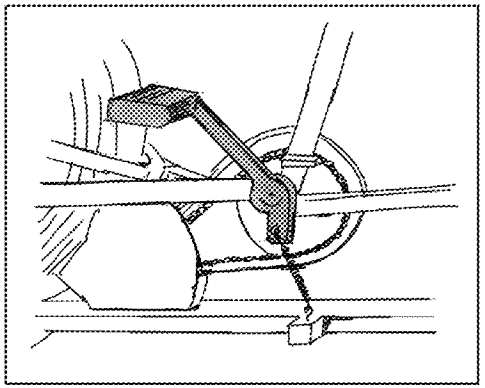

The positions of the reciprocating motion of FIG. 3 are further illustrated in FIGS. 4*a*-4*c*. In particular, FIG. 4*a* shows the pedal in the starting or upper position wherein the user would be engaged with a bent knee. FIG. 4*b* shows an intermediate position wherein the user would be pressing down on the pedal and extending their knee. FIG. 4*c* shows the end or lowest position wherein the user would be restricted from rotating the pedal any father due to a built in stop (supra). The pedal would then return to the starting position of FIG. 4*a*.

Figure 5A:
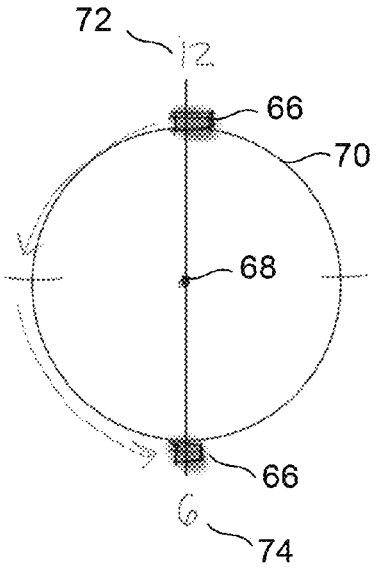
FIG. 5*a*-5*b* are simplified range of motion diagrams of various positions within the basic motions of the pedals of the device of FIG. 1.
Figure 5B:
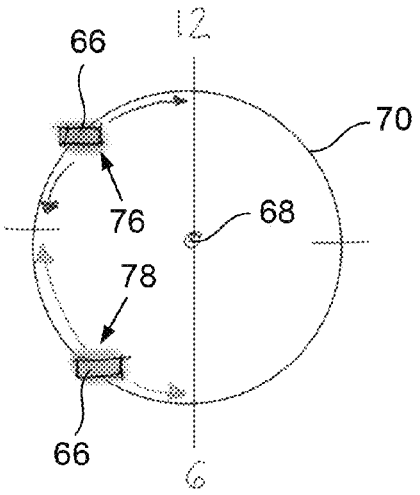

The pedals of the reciprocating device 10 move around a point, but cannot move past a set stop position. Using an analog clock as a visual exemplar, and turning now to FIG. 5*a*, the pedal 66 is shown rotating about the center 68 of the analog clock 70. In an ordinary bicycle (stationary or otherwise), the pedals would have a full 360° range of motion. In other words, the pedal 66 would make a complete circle about the center 68 in a counterclockwise direction from 12:00 (72) to 6:00 (74) and back up to 12:00 (72). By contrast, the range of motion of the pedals of the present disclosure are adjustably limited. For example, the starting position is shown at 12:00 (72) and the stopping position is shown at 6:00 (74). The total amount of rotation can be restricted as the range of motion of the patient progresses. As a further example, the limited extension is illustrated by FIG. 5*b* wherein the pedal stops can be adjusted to accommodate the range of motion of each user, starting 76 and/or stopping 78 anywhere within the full 12:00-6:00 range, for example.

Figure 6:
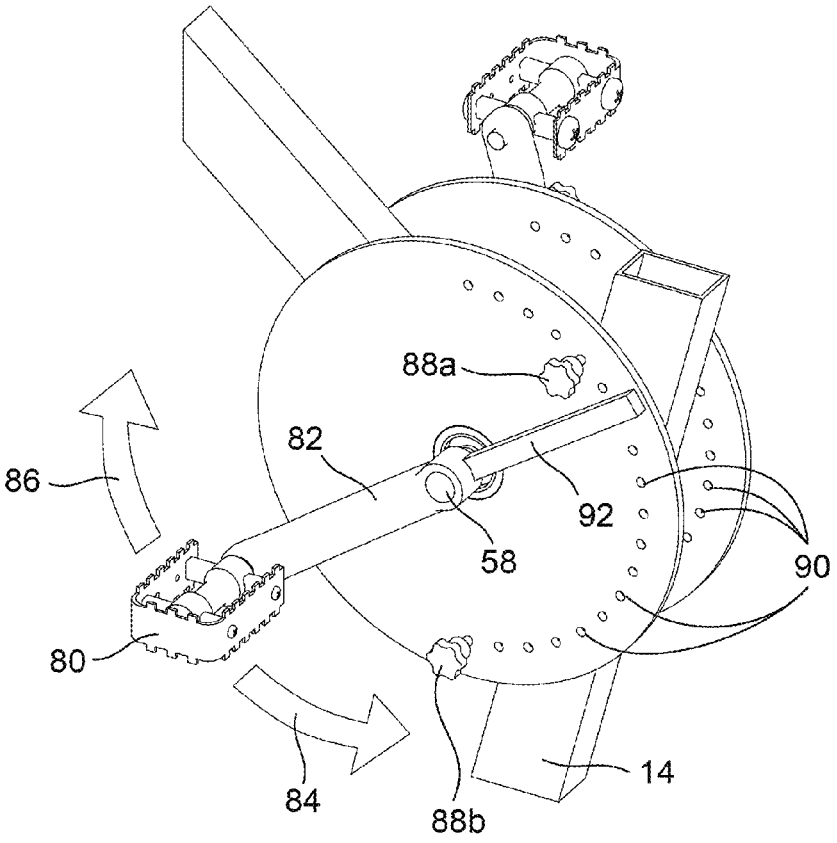
FIG. 6 is a perspective view of a finite adjustability embodiment of the range of motion of the device of FIG. 1.
Figure 7A:
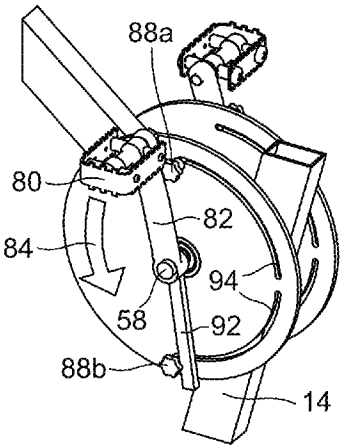
FIGS. 7*a*-7*d* are perspective views illustrating an infinite adjustability embodiment of the range of motion of the device according to the principles of the present invention.
Figure 7B:
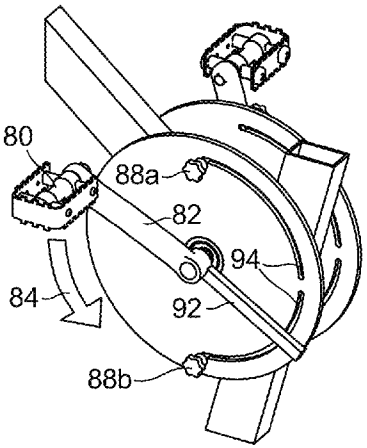
Figure 7C:
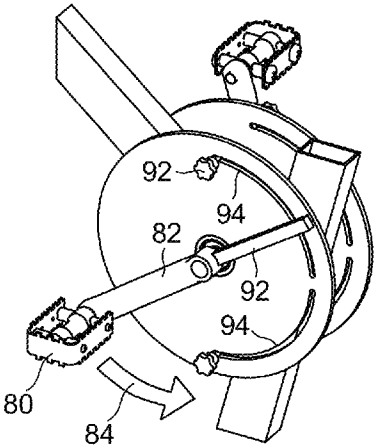
Figure 7D:
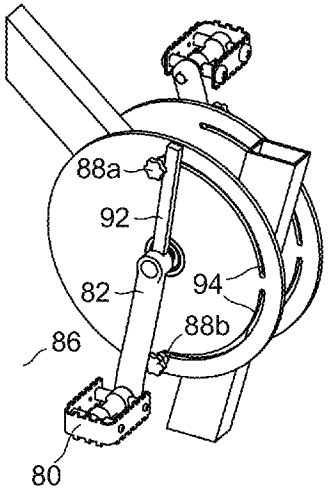

The adjustability of the start and stop positions of the reciprocating rehabilitation device 10 can be finite or infinite. An example of a finite adjustability is illustrated in FIG. 6. More particularly, the pedal 80 of FIG. 6 is rotatably mounted to the crank or lever arm 82 such that the downward force moves the pedal and the crank downward 84 conjointly. The force mechanism (infra) then urges the pedal and crank back upward 86 conjointly. This reciprocating movement is limited by utilizing one or more limiters or stops 88 along the path of the crank 82. For example, a downward stop 88*a*, in the form of a thumbscrew or the like, positioned within one of a plurality of apertures 90 (within a plate, the frame, or otherwise) along the path of travel of a crank extension arm 92 will limit the downward travel 84 of the crank arm 82 and thus the pedal 80. Similarly, an upward stop 88*b*, positioned within an aperture 90 will limit the upward travel 86 of the crank arm 82 and thus the pedal 80.

An example of an infinite adjustability range is illustrated in FIGS. 7*a*-7*d*. In particular, the pedal 80 is rotatably mounted to the crank 82 such that the downward force of a user moves the pedal and crank downward 84 conjointly, while the force mechanism urges the pedal and crank back upward 86 conjointly. Again, this reciprocating movement is limited by utilizing one or more limiters or stops 88 along the path of the crank 82. However, instead of a finite number of positions (90) to set the limiters, as shown in FIG. 6, FIG. 7 shows the stops capable of being positioned anywhere along the positioning slots 94, for example. Accordingly, downward stop 88*a* and upward stop 88*b* can be positioned to start and/or stop the movement of the pedals anywhere along the reciprocating path of travel.

Another advantageous feature of the design of the present disclosure that is not possible with common bicycles, stationary machines, etc. is the ability of the left and right pedals to move independently and/or together. Typical pedals move 180° with respect to one another, or in other words, when one pedal is on the top of the rotation the other pedal is on the bottom of the rotation. The reciprocating rehabilitation device of the present disclosure allows the patient to better use one pedal (limb) at a time and or both pedals (limbs) at the same time.

Figure 8A:
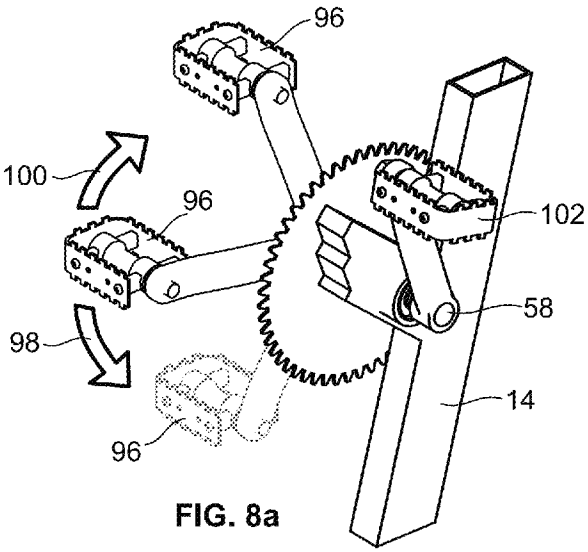
FIGS. 8*a*-8*b* are perspective views illustrating the independently moving pedals of the device of FIG. 1.
Figure 8B:
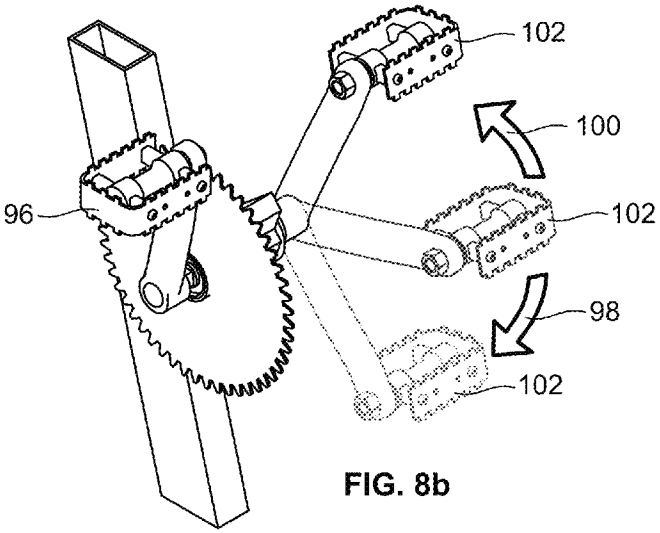

An example of the independent movement of the pedals is illustrated in FIGS. 8*a* and 8*b*. FIG. 8*a* shows the right pedal 96 moving downward 98 via the user and upward 100 due to the force mechanism as the left pedal 102 remains stationary. By contrast, and as shown in FIG. 8*b*, the left pedal 102 moves downward 98 and back upward 100 while the right pedal 96 remains stationary.

Figure 9:
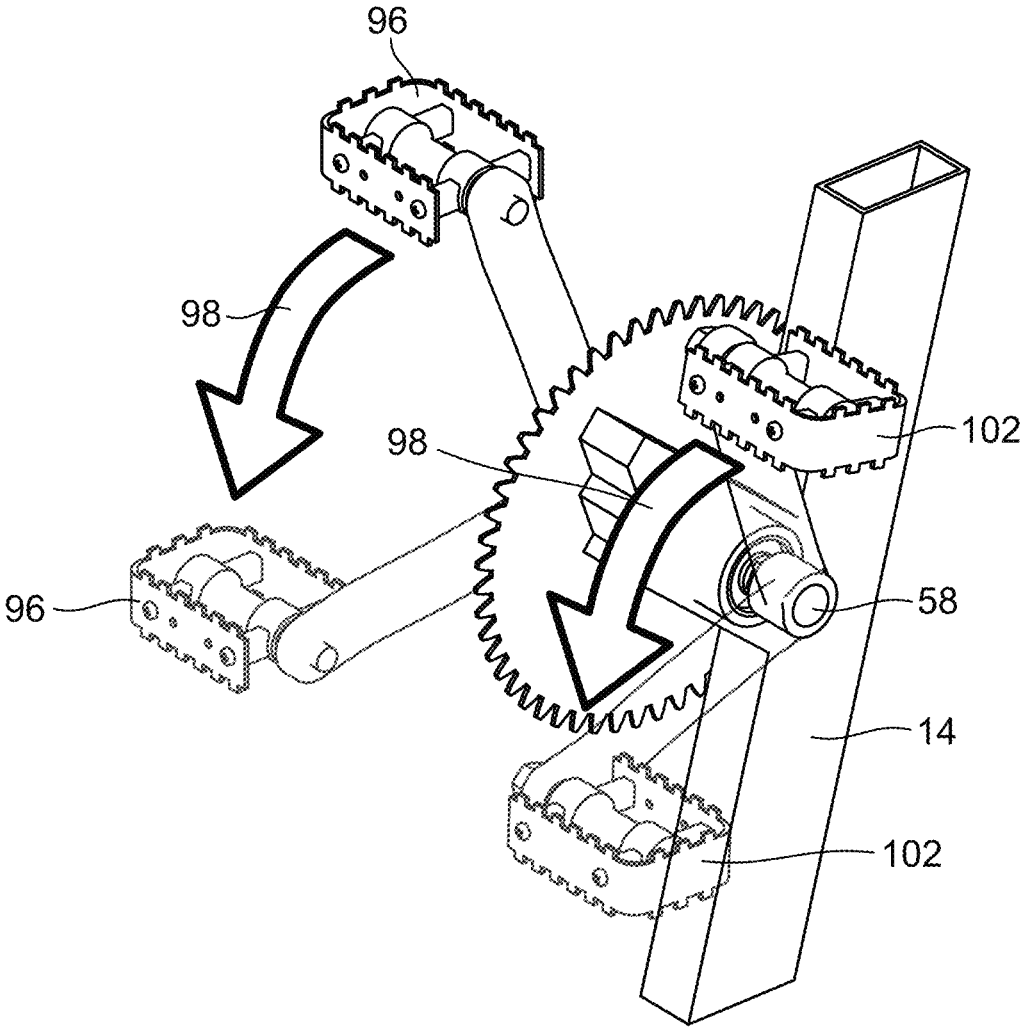
FIG. 9 is a perspective view illustrating both pedals of the device of FIG. 1 moving simultaneously.

On the other hand, an example of both pedals moving together is illustrated in FIG. 9. Both the right pedal 96 and the left pedal 102 can move down 98 (and up) together or at the same time. Accordingly, as each pedal is independent, the patient (and therapist) can utilize one or both depending on the needs of the rehabilitation process.

It will be understood that the pedal assembly of the present disclosure need not be incorporated within a stationary bicycle. Indeed, the device could merely consist of a frame, pedals and their respective cranks, a downward resistance element, an upward biasing element and one or more range of motion stops. Such an embodiment could be utilized by a patient in a wheelchair (or other chair) or someone in a standing position.

The foregoing detailed description has been given for clearness of understanding only and no unnecessary limitations should be understood therefrom. Accordingly, while one or more particular embodiments of the disclosure have been shown and described, it will be apparent to those skilled in the art that changes and modifications may be made therein without departing from the invention if its broader aspects, and, therefore, the aim in the appended claims is to cover all such changes and modifications as fall within the true spirit and scope of the present disclosure.

What is claimed is:

1. A reciprocating rehabilitation device, the device comprising:

a frame;

a crank axle supported by said frame, said crank axle having two ends;

a first foot pedal coupled near one end of said crank axle through a first crank arm wherein said first pedal having a generally circular range of motion about said crank axle;

a resistance element for resisting pedal motion in a first direction within said range;

a force element for forcing pedal motion in a second direction within said range; and;

a plurality of apertures disposed along said range of motion whereby insertion of a stop element within one of said apertures adjusts said range of at least one of said directions.

2. The device of claim 1 further comprising a second pedal near the other end of said crank axle through a second crank arm wherein said second pedal having a circular range of motion about said crank axle.

3. The device of claim 2 wherein said first and second crank arms independently move through their respective range of motion.

4. The device of claim 1 wherein the device is operably coupled to a stationary bicycle.

5. A reciprocating foot pedal assembly, the assembly comprising:

a frame;

a crank axle supported by said frame, said crank axle having a left and a right end;

a left and right foot pedal coupled near respective ends of said crank axle through crank arms wherein said pedals each have a generally circular range of motion about said crank axle;

a resistance element for resisting pedal motion in a first direction within said range;

a force element for forcing pedal motion in a second direction within said range; and;

a plurality of apertures disposed along said range of motion whereby insertion of a stop element within one of said apertures adjusts said range of at least one of said directions.

6. The assembly of claim 5 wherein said first and second crank arms independently move through their respective range of motions.

7. The assembly of claim 5 wherein said assembly is operably coupled to a stationary bicycle.

8. A reciprocating rehabilitation device, the device comprising:

a frame;

a crank axle supported by said frame, said crank axle having two ends;

a first foot pedal coupled near one end of said crank axle through a first crank arm wherein said first pedal having a generally circular range of motion about said crank axle;

a resistance element for resisting pedal motion in a first direction within said range;

a force element for forcing pedal motion in a second direction within said range; and;

a generally circular shaped slot following said range of motion whereby a stop element is positionable within said slot for adjusting said range of at least one of said directions.

* * * * *